United States Patent [19]

Mancuso

[11] 4,398,373

[45] Aug. 16, 1983

[54] VINYL FRAME, MULTI-PANEL, SLIDING DOOR ASSEMBLY

[75] Inventor: Paul Mancuso, Mamaroneck, N.Y.

[73] Assignee: Fiberlux Products, Inc., Mount Vernon, N.Y.

[21] Appl. No.: 210,514

[22] Filed: Nov. 28, 1980

[51] Int. Cl.[3] ..... E05D 13/02

[52] U.S. Cl. ..... 49/425; 49/458; 49/504; 52/207

[58] Field of Search ..... 49/425, 404, 504, 406, 49/458, 454, 456; 52/207; 411/437, 908, 907

[56] References Cited

U.S. PATENT DOCUMENTS

| | | | |
|---|---|---|---|
| 2,911,689 | 11/1959 | Kelly | 49/425 |
| 3,175,255 | 3/1965 | Saunders | 49/425 |
| 3,487,580 | 1/1970 | Holliday | 49/425 X |
| 3,520,084 | 7/1970 | Gigante . | |
| 3,530,618 | 9/1970 | Grossman . | |
| 3,703,063 | 11/1972 | Budich et al. . | |
| 3,859,754 | 1/1975 | Budich et al. . | |
| 4,259,813 | 4/1981 | Winner et al. | 49/504 |
| 4,286,716 | 9/1981 | Budich et al. | 49/425 X |

FOREIGN PATENT DOCUMENTS

| | | | |
|---|---|---|---|
| 597645 | 5/1960 | Canada | 411/437 |
| 2061901 | 6/1972 | Fed. Rep. of Germany . | |
| 2153746 | 5/1973 | Fed. Rep. of Germany . | |
| 2258998 | 6/1974 | Fed. Rep. of Germany . | |
| 2354861 | 5/1975 | Fed. Rep. of Germany . | |
| 2451814 | 5/1976 | Fed. Rep. of Germany . | |
| 2451816 | 6/1976 | Fed. Rep. of Germany . | |

*Primary Examiner*—Philip C. Kannan

*Attorney, Agent, or Firm*—Brumbaugh, Graves, Donohue & Raymond

[57] ABSTRACT

A sliding glass door assembly comprises a frame of rigid plastic, for example polyvinyl chloride, extruded in the form of a plurality of adjacent hollow sections. The upright and horizontal frame members are attached together by screws extending horizontally through the upright members into longitudinally extending screw bosses in the horizontal frame members. The frame members include depending guides for supporting door panels, at least one of which slides open and closed. The door panels are formed of vertical and horizontal sash members which support at least one, but preferably several, glass panels. The sash members are also formed of plural hollow sections that cooperate for strength, and are attached by screw bosses. Preferably, the screw bosses in the sash of the moveable panel or panels are contained in the upright sash members, and preferably each upright sash member has a pair of screw bosses for attaching not only the lower sash member, but also for attaching roller elements at each end of the moveable sash. The roller elements are supported on a track held in the lower horizontal frame member.

16 Claims, 2 Drawing Figures

VINYL FRAME, MULTI-PANEL, SLIDING DOOR ASSEMBLY

BACKGROUND OF THE INVENTION

The present invention relates to sliding door frame structures, primarily sliding glass doors which are commonly used as patio doors and the like.

Sliding door assemblies normally have two or more panels, at least one of which slides, along a track, supported in a frame. To allow proper door functioning, the frame must be rigid and strong enough to withstand substantial perpendicular loading, due not only to environmental loading, i.e. wind loads, but also to forces exerted during use. The problem of bending of the frame members is complicated by their lengths, which in sliding doors can be 8–12 feet. As a result, loads applied to the frame can, depending upon how the frame is installed in the jamb, create substantial bending moments.

In addition to perpendicular loads, the frame must be capable of withstanding axial stresses imparted during opening and closing movement of the sliding door or doors, such that the track and frame remain rigid.

For aesthetic effect, the door panels, when used as outside doors, are formed almost entirely of glass, which results in panes of substantial size. Due to the large glass area, each of the panes is necessarily extremely heavy, on the order of 250 lbs. per pane. This requires a frame structure which is strong enough to support substantial weight, and durable to hold up to repetitive door opening and closing motions under substantial stress.

Concern for thermal insulation of doors and windows, through which considerable heat loss can occur, coupled with the fact that sliding glass doors have a large glass surface area and glass is a relatively poor insulator of heat, has almost necessitated the use of double or triple glazing in the door panels. This not only complicates the frame configuration, but the substantial additional weight resultant from the added panes of glass places significant additional strain on the frame support members. It is for this reason too, thermal efficiency, that it is necessary to retain rigidity of the frame and door members to resist bending under wind loads as would cause excess infiltration of air (and water), and loss of heat.

These heavy load and stress factors have severely inhibited the use of rigid plastic as the frame and sash members in the sliding glass door assembly, although from the standpoint of cost and ease of manufacture the use of a rigid plastic frame and sash would be greatly desirable. However, in order to be capable of withstanding the in-use conditions of the sliding glass door, the plastic members would have to have a relatively thick construction. Alternatively, if plastic members of relatively thin wall thickness were used, metal reinforcement members would be required to prevent bending or cracking of the plastic. In either case, the cost savings advantage of using plastic in the first place would be obviated due both to material costs and construction costs.

SUMMARY OF THE INVENTION

The present invention is a novel construction for a sliding door assembly in which the door frame structure and door sashes may be formed entirely of rigid plastic, for example rigid polyvinyl chloride.

In the sliding glass door assembly, the frame includes four elongated plastic members. Each member is extruded with relatively thin plastic walls, but has a cross-section of a plurality of adjacent, cooperating hollow sections to provide interlocking strength and rigidity to the overall elongated member. The four elongated members are assembled together as the basic frame unit. The surfaces facing outwardly from the frame include projections to engage the jamb, for example in the wall of a building, and the frame surfaces facing inwardly have guides for supporting the sliding glass door panels. The four frame members may be extruded, cut to the appropriate lengths, and assembled in the form in which they are initially extruded, without the use of additional metal supports, metal brackets, or other reinforcing members. As such the structure may be assembled on site, for example as a replacement door or in a new home construction, quickly and easily.

The upright members include, as viewed in cross-section, a plurality of in-line hollow structural sections separated by smaller hollow sections adapted to accept screws. The screws, when the frame is assembled, extend through the smaller hollow sections of the upright members and screw into longitudinally extending plastic screw bosses in the upper and lower frame members. The screw boss arrangement per se is also the subject of an application by the same inventor, U.S. application Ser. No. 163,092, filed June 26, 1980, the disclosure of which is incorporated herein by reference. When used in conjunction with the frame members described herein, the screw boss arrangement permits the frame members to be assembled without the use of a separate metal screw boss insert, and at the same time is capable of withstanding the normal bending and torsional loads transmitted across the joints. Moreover, the screw boss arrangement is formed entirely of plastic and is extruded at the same time as the upper and lower frame members are extruded. Accordingly, it is highly desirable from a cost standpoint.

The upper and lower frame members are also constructed in the form of adjoining hollow sections with the hollow sections separated by the axially extending screw bosses. As in the case of the upright frame members, the upper and lower frame members also have depending guides, structurally formed as hollows, extending inwardly into the space defined by the frame to capture and guide the sash members of the sliding doors.

The panes of the sliding glass door panels are supported in sash members. The sash members may also be formed entirely of rigid plastic, for example rigid polyvinyl chloride, and for strength are formed as cooperating hollow sections in a manner similar to the frame members. The sash members are constructed from four elongated extruded-plastic members which engage the panes of the door panel and which are attached to each other by longitudinally extending plastic screw bosses in the vertical sash members, such that mounting screws extend through the horizontal sash members into the screw bosses of the vertical members to form a unitary sash.

In accordance with the invention, the frame and sash members may be constructed entirely out of rigid polyvinyl or other plastics. Despite the substantial lengths of the members and weight of the glass panels, the cooperating hollows of the frame provide the frame and sash assemblies with the requisite strength, rigidity, and durability needed to stand up under normal wind loads and provide low permeability to air and water infiltration without the need for aluminum or steel reinforcing members.

The design is simple in construction and easy to assemble in view of the novel screw boss arrangement in the upper and lower cross members, and the screw supporting hollow sections in the upright members. In addition, each of the structural plastic members is uniform in cross-section along its entire length, and thus may easily and inexpensively be fabricated by continuous extrusion of plastic. The frame members may be cut to size on site to accommodate minor variations in jamb opening sizes, and no matter what length, can still be readily assembled due to the uniformity in cross-section, and thus availability of the screw boss, no matter where the frame members are cut.

The strength provided by the cross-sectional design of the frame and sash members, in which individual hollow sections cooperate with other hollow sections to impart an overall strength in excess of any individual wall of the thin plastic, permits the use of multiple glazing in the door panels without adversely affecting the durability and performance of the door.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 1:
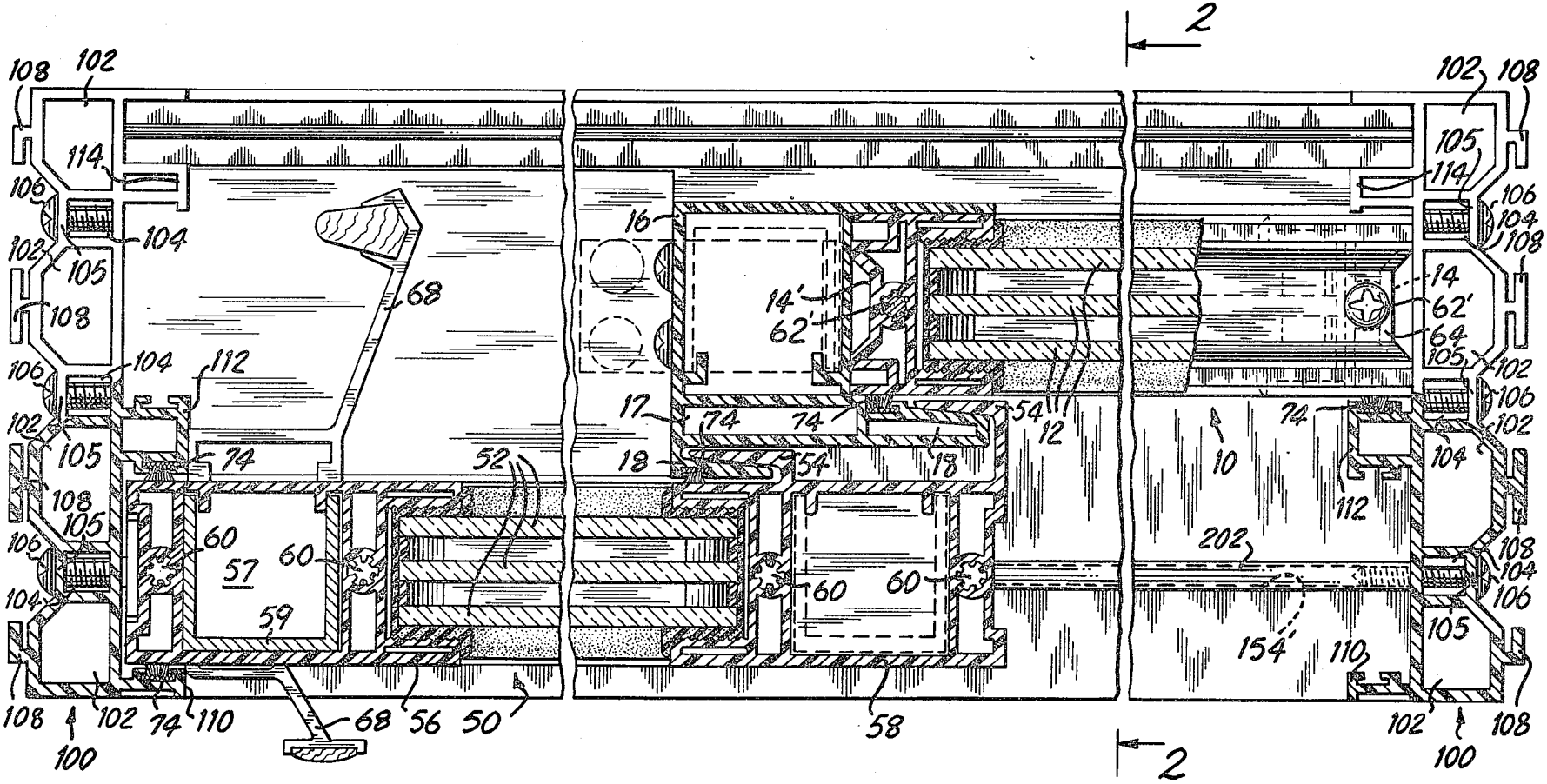
FIG. 1 is a top view, partially in section, of a sliding glass door assembly in accordance with the invention with the top horizontal frame member removed.
Figure 2:
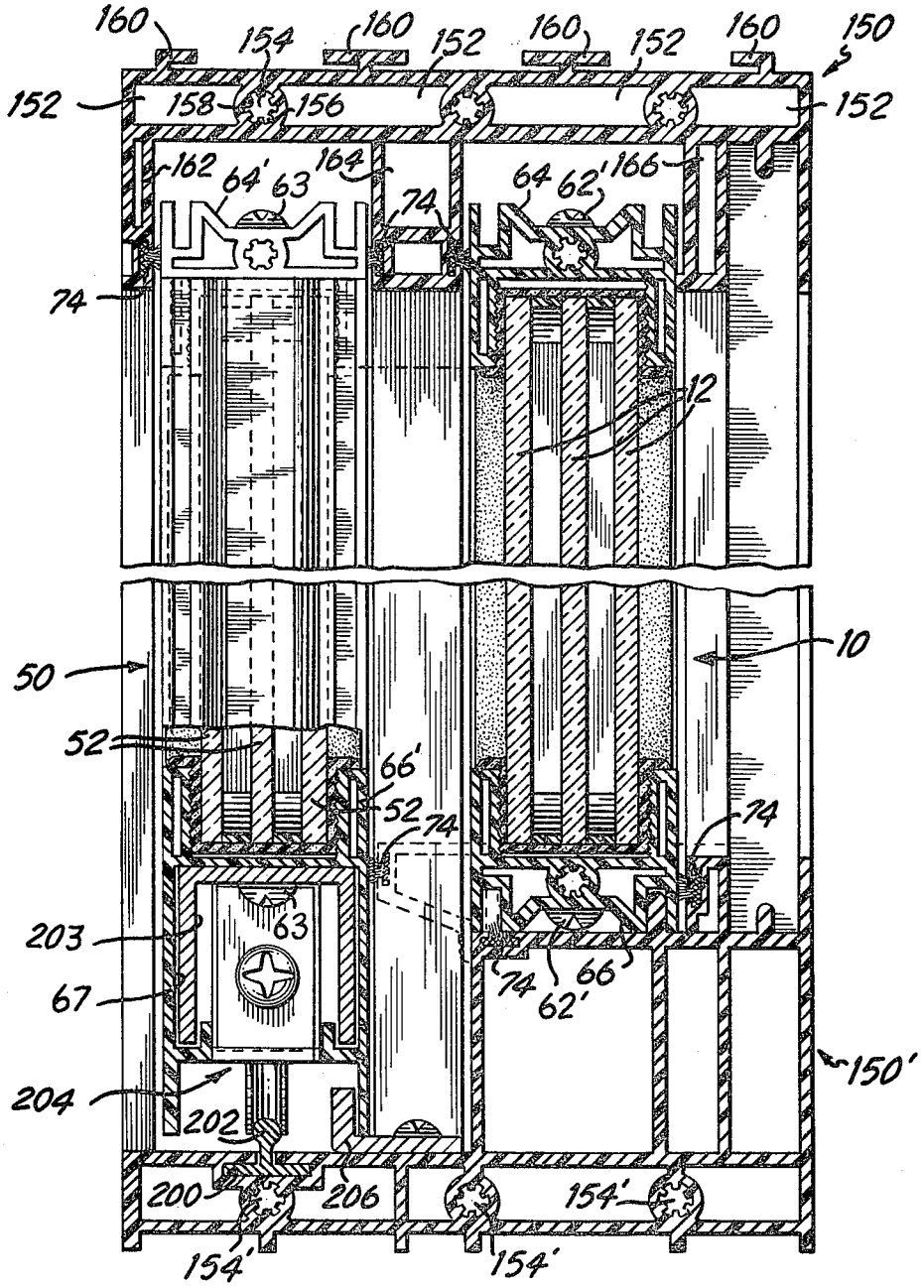
FIG. 2 is a side sectional view, taken through lines 2—2, of the sliding glass door assembly of FIG. 1.

Referring to the drawings, a sliding glass door assembly has a fixed door panel 10 and a sliding door panel 50. The door panels 10 and 50 are supported in a door frame which is formed entirely of extruded rigid plastic members, in the form of a pair of upright frame members 100 (FIG. 1), and a pair of horizontal frame members 150 and 150' (FIG. 2). For clarity, the upper horizontal frame member 150 is removed from FIG. 1.

Each of the upright frame support members 100 is made of extruded rigid vinyl plastic, for example polyvinyl chloride, and includes a plurality of aligned hollow structural sections 102 separated by smaller hollow sections 104 to provide interlocking strength of the members 100. The smaller hollow sections 104 are adapted to accept screws 106 which extend through the upright members, and which engage screw bosses 154 and 154' in the upper and lower frame members 150 and 150' as described further on. Preferably the smaller hollow sections 104 are sized so that the surface of the outside wall 105 which engages the screw head is only slightly larger than the screw head. The larger hollow sections 102 include outwardly projecting jamb engaging sections 108, and also include upright inwardly projecting posts 110, 112 and 114 for capturing and supporting the sash members of the door panels 10 and 50. The inwardly projecting posts 112 and 114, which support the fixed door panel 10 and secure the sliding panel 10 against wind loads, are provided as hollow structural sections to provide added strength. The respective upright frame members 100 are mirror images of one other and may be extruded in continuous form, cut to size, and merely inverted relative to each other to form the mirror sections. This provides savings in manufacturing costs, and facilitates on-site fabrication and re-sizing, where needed, of the frame members.

Referring to FIG. 2, in which the horizontal frame members 150 and 150' are shown in cross-section, the upper frame member 150 is constructed in the form of adjoining hollow sections 152 with the sections 152 separated by axially extending screw bosses 154. Such screw bosses are described in greater detail in the applicant's co-pending application Ser. No. 163,092, filed June 26, 1980. Each of the screw bosses 154 is formed entirely of plastic and includes a longitudinally extending bore 156 adapted to receive the screws 106 illustrated in FIG. 1, and also includes a plurality of inwardly projecting ribs 158. With the provision of the plastic screw bosses 154, the upper and lower frame members 150 and 150' may be quickly and easily attached to the vertical frame members 100 during installation. As shown in FIG. 1, the screws 106 extend through the upright frame members 100 and thereafter extend into the screw bosses 154, 154' (for purposes of illustration, one of the screws 106 is shown extending into one of the lower screw bosses 154'; for clarity, the screws 106 are omitted in FIG. 2). The screws are twisted into the screw bosses 154, where the screw threads cut cooperating threads in the spaced ribs 158 to lock the screws in place. Due to the longitudinal extension of the bosses 154, a secure mounting is provided between the frame members 100, 150 and 150', which is resistant to twisting and other torsional forces and produces a rigid unitary structural frame assembly without the need for any metal supporting hardware at the joints other than the attaching screws 106.

Since as described before the wall 105 of the small hollow sections 104 that engages the screw head is kept small, the wall is not subjected to a substantial movement or bending by the force of the screwed-down screw toward the screw boss 154. Also, since the size of the hollow space of the sections 104 is relatively small, the tendency of the walls defining the hollow sections 104 to buckle under twisting load would be minimal. Thus, the high stress loading of the upright beams 100 at the screw joints will not cause failure of the structure, or cracking of the relatively thin plastic wall engaging the screw head.

The upper horizontal frame member 150 includes a plurality of outwardly extending jamb engaging sections 160, and also includes downwardly dependent door guides 162, 164, and 166, which support the fixed door panel 10 and function as sliding supports for the sliding glass door panel 50.

The lower frame member 150' is also formed entirely of rigid plastic and is extruded in the form of a plurality of abutting hollow sections for interlocking support. The lower frame member 150' supports the fixed door panel 10, and also provides a moveable support surface for the sliding glass door panel 50. For the sliding panel, the lower frame member 150 has a track receiving recess 200, which receives a longitudinally extending metal track 202. The track 202 supports a pair of spaced roller assemblies 204, one of which is shown in FIG. 2, which are attached to the lower sash member 66 by screws 62 that extend up into screw bosses 60 in each upright sash, members 56, 58, of the sliding panel 50. The lower frame member 150' may also include an auxiliary guide bracket 206 which extends adjacent to a longitudinal portion of the lower sash 66 of the sliding glass door panel 50, to provide further support and resistance to wind loads on the door panel 50, and to prevent the roller assembly 204 from de-railing due to pull forces exerted on the door during opening and closing movement, or attempted forced entry from outside. As shown in FIG. 2, the lower door assembly also includes a plurality of longitudinally extending screw boss assemblies 154', which are similar to the screw boss assemblies 154 provided in the upper frame members 150. The upright frame members 100 are thus easily attached to the lower frame member 150' by screws 106 extending through the hollow sections 104 into the lower screw bosses 154'.

The upper and lower frame members 150 and 150' are formed as extruded plastic, for example polyvinyl chloride, and after extrusion, cut to size, since each member 150 or 150' is uniform in cross-section along its entire length.

As shown in the figures, the sash members for the glass door panels 10 and 50 are also constructed of hollow cross-section, and may be formed entirely of rigid plastic. In the illustrated embodiment, both the fixed glass door panel 10 and the sliding glass door panel 50 employ triple glazing 12 and 52 and/or single or dual glazing for effective thermal insulation.

Referring to the fixed door panel 10, the sash has a pair of upright sash members 14, 14' and a pair of horizontal sash members 64, 66 formed of extruded hollow sections of rigid plastic. All of the sash members 14, 14', 64 and 66 are identical in cross-section and may be extruded from the same die. Each of the panes 12 is sealed in the upright sash members 14 and 14'. The upright sash member 14 is supported between a pair of inwardly projecting posts 112 and 114 on the frame member 100. The inner upright sash member 14' is supported in a vertically extending post 16 projecting between the horizontal frame members 150 and 150', and provides lateral support for the fixed panel 10 as well as the sliding panel 50, the latter through a hollow extension portion 17. The extended portion 17 includes extending interlock portions 18 which capture and receive cooperating interlock portions 54 in the sliding glass door assembly 50.

The panes 52 of the sliding door panel 50 are sealed in a pair of upright sash members 56 and 58 which are similar in cross-section, the member 58 including interlock portions 54. Each upright sash member 56 and 58 includes a pair of spaced longitudinally extending screw bosses 60 which are substantially the same as the screw bosses described in connection with the upper and lower horizontal frame support members 150 and 150'. These screw bosses 60 are used to attach the roller housings 204 at either end of the panel 50.

As shown in FIG. 2, the horizontally extending sash members 64 and 66 of the stationary panel 10 are supported and captured in portions of the horizontally extending frame members 150 and 150'. Each of the sash members 64 and 66 has posts which enclose and seal the glass panes 12. When the panel 10 is assembled, mounting screws 62' extend vertically through apertures in the horizontal sash members 64 and 66 and thereafter into the screw bosses 63 of the vertical sash members 14 and 14' to form a unitary sash.

The upper sash member 64' of the sliding panel 50 slides between projecting guides 162 and 164. As described above, the lower sash 66' of the sliding panel 50 is held by track 202 and optionally by bracket 206. The lower sash 66' of the sliding panel 50 has a channel 67 in which the roller elements 204 are positioned at either end of the panel 50. Each of the roller elements 204 are attached to the sash 66' using a pair of spaced screws 63, which extend through a mounting bracket 203 on each roller element 204 into the screw bosses 60 of each of the upright sash members 56 and 58. For the sake of clarity, the screws 63 are omitted in FIG. 2. The top sash member 64' also screws down onto the upright sash members 56 and 58 by screws 63 that extend through apertures in the horizontal sash member 64' down into the screw bosses 60 of the members 56 and 58.

As shown in FIG. 1, the sliding glass door panel 50 is provided with inside and outside pull handles 68 to facilitate opening and closing of the sliding door. Although not shown, a lock mechanism may be provided in the upright sash member 56, positioned within the hollow space 57 of the member 56, to engage a cooperating latch in the upright frame member 100. A metal support channel 59 may be inserted into the hollow space 57 to provde a strengthened attachment surface for the lock and the pull handles 68.

Preferably, weather stripping elements 74 are provided at various joints and interfaces between the sash and frame members to inhibit air and water infiltration through the assembly. The frame joints and sash joints are also preferably cemented together for added strength. The screw and screw boss arrangements clamp the joints together while the cement sets to form a good bond. Since auxiliary clamps are not needed, PVC extrusion cement may be applied and the unit installed without having to wait for setting to occur, which would in other cases delay installation.

The frame and sash members may be made entirely out of rigid polyvinyl chloride or other rigid plastic (with the exception, of course, of the locks, possibly the door handles, the roller mechanism for the sliding door, and whatever other hardware accessories may be provided). However, the basic frame and sash may be made entirely out of plastic. Despite the substantial lengths of the members and weight of the glass panels, which especially in the case of double or triple glazing is substantial, the frame and sash assemblies due to the cooperating hollows in the frame illustrated in the drawings, provide the requisite strength, rigidity, and durability to stand up under normal wind loads and provide low permeability to air and water infiltration without the need for aluminum or steel reinforcing members. In addition, as described above the design is simple in construction and easy to assemble in view of the novel screw boss arrangement in the upper and lower cross-members and screw supporting hollow sections in the upright members of the frame, and the corresponding screw boss assembly arrangements in the sash members. Each of the frame and sash members may be formed by continuous extrusion, and cut to any desired frame size, since at each point the cross-section assembly surfaces would be identical. Also, as described above, many of the members are identical, i.e. the upright frame members 100, and the fixed panel sash members 14, 14' and 64 (the upper sash member 64' is also identical), and thus may be cut from the same extrusion.

The foregoing represents a description of the preferred embodiments of the invention. Variations and modifications will be apparent to persons skilled in the art without departing from the inventive concepts disclosed herein. For example, while in the illustrated embodiment, a sliding glass door assembly is shown which includes one fixed panel and one sliding panel, it is apparent that both panels could slide, or that additional sliding or fixed panels could be added to form a multiple panel door. Also, while a preferred arrangement for hollow sections has been illustrated, it is possible to vary the cross-sectional configuration of the frame and sash members and still provide the requisite strength and rigidity required for the frame and sash members, that is, such that adjacent hollow sections cooperate to impart overall strength and rigidity to the elongated plastic sections in excess of the individual plastic per se, which is relatively thin in cross-section. All such modifications and variations are intended to be within the scope of the present invention, as set forth in the following claims.

I claim:

1. A frame assembly for a door having at least one sliding panel comprising a pair of elongated upright frame members formed of rigid plastic, a pair of elongated horizontal frame members formed of rigid plastic, means for rigidly attaching said horizontal members to said upright members to form a frame, and guide means on said frame members for supporting said panel and for moving said panel longitudinally between closed and open positions, wherein each said member is formed to have, in cross-section, a series of laterally contiguous hollow sections cooperating to render each frame member rigid over its entire length and forming a rigid frame assembly which is capable of supporting a sliding door assembly; wherein said series in one of said upright frame members and said horizontal frame members comprises a plurality of in-line, first hollow sections, separated by smaller, second hollow sections arranged to accept attaching screws, wherein said second hollow sections maintain the rigidity of said frame members and are capable of withstanding compressive and bending forces associated with attaching the horizontal and vertical frame members together at said second hollow sections.

2. A frame assembly as defined in claim 1, wherein each hollow section of said series is defined by a plurality of walls, and the internal angle between adjacent walls is less than 180°.

3. A frame assembly as defined in claim 2, wherein said series in the other of said upright frame members and said horizontal frame members each comprises a plurality of in-line third hollow sections, contiguous third hollow sections being separated by plastic screw bosses formed integral with said other frame members, wherein said screw bosses are positioned to be aligned with said smaller, second hollow sections in said one members, wherein each screw boss section comprises a plastic boss section extending lengthwise through said frame member and having an aperture extending lengthwise therethrough, and a plurality of ribs extending lengthwise and projecting into said aperture for engaging the threads of a screw inserted through said smaller, second hollow sections, and wherein the rigid attaching means includes a plurality of screws projecting through second hollow sections in said one frame members and screwed into associated screw bosses in said other frame members.

4. A frame assembly as defined in claim 3, wherein each said screw boss defines at least one wall in each of adjacent hollow sections in said series of hollow sections, and wherein said upright and horizontal members are formed by extrusion.

5. A door assembly comprising at least two panels, each panel comprising a plurality of sash members, and a frame assembly, said frame assembly comprising a plurality of elongated frame members formed of rigid plastic for supporting said panels, depending members for capturing and supporting said panels, and guide means for supporting said panels and for permitting at least one of said panels to move longitudinally, in a horizontal direction between closed and open positions, wherein each frame member is formed to have, in cross-section, a series of laterally contiguous hollow sections cooperating to support adjacent hollow sections to render each member rigid over its entire length and forming a frame assembly which is capable of supporting glass door panels, wherein said series in one of said upright frame members and said horizontal frame members comprises a plurality of in-line, first hollow sections, separated by smaller, second hollow sections arranged to accept attaching screws, wherein said second hollow sections maintain the rigidity of said frame members and are capable of withstanding compressive and bending forces associated with attaching the horizontal and vertical frame members together at said second hollow sections.

6. A door assembly as defined in claim 5, wherein one panel is fixed in said frame members, wherein the sash members of said fixed panel comprises four sash members identical in cross-section, each member having a plastic screw boss extending lengthwise therethrough, each said screw boss comprising a plastic boss section having an aperture arranged therein, and a plurality of ribs in said aperture and arranged therein, and wherein each sash member comprises depending portions thereof for mounting at least one pane of glass.

7. A door assembly as defined in claim 5, wherein each panel employs multiple glazing.

8. A door assembly as defined in claim 5, wherein one sash member includes a vertically extending, hollow post centrally arranged between said vertical frame members for supporting said sliding panel.

9. A door assembly as defined in claim 5, wherein each panel includes at least one glass pane, wherein the sash members of each panel are connected to form a panel frame for supporting said glass pane, and wherein each sash member includes a pair of transversely spaced, inwardly extending hollow sections depending therefrom, defining a channel for receiving said glass pane.

10. A door assembly as defined in claim 5, wherein the sash members of said one moveable panel are formed with at least one hollow section and comprise a pair of upright sash members and a pair of horizontal sash members attached thereto, wherein at least one of said upright and horizontal sash members each has a screw boss extending therethrough, each said screw boss comprising a plastic boss section, having an aperture therethrough, extending lengthwise through said sash member, and a plurality of spaced ribs extending along said aperture, wherein said screw bosses provide an attaching surface for the other of said horizontal and vertical sash members.

11. A door assembly as defined in claim 10, wherein each upright sash member on said moveable panel has, in cross-section, a plurality of longitudinally arranged hollow sections and a pair of longitudinally spaced screw bosses extending lengthwise through said upright sash members to provide an attaching surface for said horizontal sash members, wherein said guide means comprises track means on said frame, roller means for supporting said moveable panel and engaging said track means, and means for attaching said roller means to the upright sash members of said moveable panel comprising screws engaging said roller means and screwed into said screw bosses in said upright sash members, wherein said roller means are longitudinally spaced along said moveable panel at either end thereof.

12. A door assembly as defined in claim 5, wherein said series in the other of said upright frame members and said horizontal frame members each comprises a plurality of in-line, third hollow sections, contiguous third hollow sections being separated by plastic screw bosses formed integral with said other frame members, wherein said screw bosses are positioned to be aligned with said smaller, second hollow sections in said one members, wherein each screw boss section comprises a plastic boss section extending lengthwise through said frame member and having an aperture extending lengthwise therethrough, and a plurality of ribs extending lengthwise and projecting into said aperture for engaging the threads of a screw inserted through said smaller, second hollow sections, and wherein the rigid attaching means includes a plurality of screws projecting through second hollow sections in said one frame members and screwed into associated screw bosses in said other frame member.

13. A door assembly as defined in claim 12, wherein an upright sash member of each panel includes a vertically extending interlock portion, and wherein said interlock portions are mutually captured and received when said panels are in a closed position.

14. A door assembly as defined in claim 13, wherein the screw bosses in said frame members are arranged in said horizontal frame members, and wherein said horizontal frame members include a lower frame member, said track means being associated with said lower frame member for supporting said sliding panel, and wherein a screw boss extends lengthwise through said lower frame member under said track means for supporting the weight of said sliding panel.

15. A door assembly as defined in claim 14, wherein said lower frame member is formed with a track receiving recess, and wherein said track means comprises a track disposed in said track receiving recess and positioned over the panel supporting screw boss.

16. A door assembly as defined in claim 5 or 14, wherein said horizontal frame members include an upper frame member, and wherein said depending members are arranged on said upper frame member and comprise a plurality of downwardly depending hollow sections defining a pair of channels for supporting, in a transverse direction, respective panels.

* * * * *

UNITED STATES PATENT OFFICE

CERTIFICATE OF CORRECTION

Patent No. 4,398,373 Dated August 16, 1983

Inventor(s) PAUL MANCUSO

It is certified that error appears in the above-identified patent and that said Letters Patent are hereby corrected as shown below:

Column 7, line 45, "claim 2" should read -- claim 1 --.

Signed and Sealed this

*Eighteenth* Day of *October 1983*

[SEAL]

*Attest:*

GERALD J. MOSSINGHOFF

*Attesting Officer*

*Commissioner of Patents and Trademarks*